US009561416B1

(12) United States Patent
Gesicki et al.

(10) Patent No.: US 9,561,416 B1
(45) Date of Patent: Feb. 7, 2017

(54) NET BOUNDARY INDICATOR

(71) Applicants: Gregory Paul Gesicki, Chandler, AZ (US); Erin Marie Gesicki, Chandler, AZ (US); Terese Marie Gesicki, Chandler, AZ (US)

(72) Inventors: Gregory Paul Gesicki, Chandler, AZ (US); Erin Marie Gesicki, Chandler, AZ (US); Terese Marie Gesicki, Chandler, AZ (US)

( * ) Notice: Subject to any disclaimer, the term of this patent is extended or adjusted under 35 U.S.C. 154(b) by 62 days.

(21) Appl. No.: 14/485,456

(22) Filed: Sep. 12, 2014

Related U.S. Application Data

(60) Provisional application No. 61/877,945, filed on Sep. 14, 2013.

(51) Int. Cl.
*A63B 61/00* (2006.01)
*A63C 19/06* (2006.01)

(52) U.S. Cl.
CPC ..... *A63B 61/003* (2013.01)

(58) Field of Classification Search
CPC ..... A63B 61/00; A63C 19/06
USPC ..... 473/477, 467; 248/538–539; 403/391; D8/356, 395
See application file for complete search history.

(56) References Cited

U.S. PATENT DOCUMENTS 123,456 A * 2/1872 Cowdery ..... C40B 10/00 434/425
3,860,240 A * 1/1975 Koch ..... A63B 61/006 248/539
3,940,139 A * 2/1976 Barnes ..... A63B 61/006 248/125.2
4,671,509 A * 6/1987 Newman ..... A63B 61/04 473/495
5,481,809 A * 1/1996 Rooney ..... G01C 15/105 33/286
5,954,308 A * 9/1999 Lane ..... A63B 61/003 24/339
6,397,484 B1 * 6/2002 Greene ..... G01C 15/105 33/392
6,868,619 B1 * 3/2005 Boren ..... A63B 61/04 24/306
6,955,617 B1 * 10/2005 Boren ..... A63B 61/04 473/495

(Continued)

OTHER PUBLICATIONS

Webpage download, Jaypro2011 , 2011, ://web.archive.org/web/20110102064708/http://www.jaypro.com/ProductDetail.aspx?ProductName=High-School-Net, 2 pages.*

(Continued)

*Primary Examiner* — Gene Kim
*Assistant Examiner* — M Chambers
(74) *Attorney, Agent, or Firm* — Booth Udall Fuller, PLC

(57) ABSTRACT

A net boundary indicator can comprise a strap comprising an inside surface and an outside surface opposite the inside surface. A reinforcing member can comprise a top end and a bottom end, the reinforcing member being attached along a length of the inside surface of the strap. A top clip can be coupled to the strap adjacent the top end of the reinforcing member. A bottom clip can be coupled to the strap adjacent the bottom end of the reinforcing member. A first sleeve can be attached along a length of a surface of the strap. An aligning device can be coupled to the surface of the strap below the first sleeve and in-line with the first sleeve, and a bubble level can be coupled to the strap.

20 Claims, 6 Drawing Sheets

(56) References Cited

U.S. PATENT DOCUMENTS

| | | | | |
|---|---|---|---|---|
| 7,097,575 | B1 * | 8/2006 | Chen | A63B 71/023 473/494 |
| 8,522,447 | B1 * | 9/2013 | Novotny | G01C 15/105 33/485 |
| 2010/0115781 | A1 * | 5/2010 | Norelli | G01C 9/28 33/371 |

OTHER PUBLICATIONS

Webpage download , Carronnet2005 , 2005, web.archive.org/web/20050516105831/http://www.carronnet.com/Carron%20Catalog%202005%20color.pdf , 4 pages.*

Webpage download , Amazon2011, 2011, www.amazon.com/Life-guard- Master- BACKBOARD- STRAPS-Velcro/dp/B003RR36F4, 4 pages.*

Webpage download , Amazon2009,2009, www.amazon.com/Mikasa- VBN- 2- Competition- Volleyball- Net/dp/B00091PQPY?, 1 page.*

Webpage download , Youtube2012, 2012 https://www.youtube.com/watch?v=FiMNTL1fGBs , 4 pages.*

* cited by examiner

NET BOUNDARY INDICATOR

CROSS-REFERENCE TO RELATED APPLICATION

This application claims the benefit of provisional application No. 61/877,945, the entirety of the contents of which are incorporated by this reference.

TECHNICAL FIELD

The disclosure relates in general to a system and device for use with net sports, and more particularly for indicating a court boundary by coupling a pair of net boundary indicators on opposing sides of a net.

BACKGROUND

Nets are a common piece of sporting equipment that can be used for various sports including volleyball, a wallyball, a badminton, a tennis, and other sports. Sporting nets can sometimes include antennas or extension rods that are used to mark or designate boundaries of the game.

Volleyball is an example of a net sport using an antenna. A volleyball net is approximately 3 feet wide and 32 feet in length when stretched across the volleyball court. Volleyball nets normally are made of 4-inch square mesh of linen twine and re rigged at the top and bottom edges to a rope or cable in conventional manner. Volleyball rules require that a long vertically disposed antenna be suspended by the net at each sideline of the volleyball court so the antennas extend to a height of approximately 76 to 107 cm (or 2.5 to 3.5 feet) above the net. The antennas are secured to the net at approximately 8½ inches from the ends thereof and are normally in the order of ⅝ths of an inch in diameter. The antennas are typically made of fiberglass or the like.

The antennas can be secured at the top and bottom of the net, including upper and lower edges of the net, and define the lateral width of play of the volleyball court. If the ball touches one of the antennas, it is considered to be out of bounds.

SUMMARY

The foregoing and other aspects, features, and advantages will be apparent to those artisans of ordinary skill in the art from the DESCRIPTION and DRAWINGS, and from the CLAIMS. Accordingly, in an aspect, a net boundary indicator can comprise a strap comprising an inside surface and an outside surface opposite the inside surface. A reinforcing member can comprise a top end and a bottom end, the reinforcing member being attached along a length of the inside surface of the strap. A top clip can be coupled to the strap adjacent the top end of the reinforcing member. A bottom clip can be coupled to the strap adjacent the bottom end of the reinforcing member. A first sleeve can be attached along a length of a surface of the strap. An aligning device can be coupled to the surface of the strap below the first sleeve and in-line with the first sleeve, and a bubble level can be coupled to the strap.

The net boundary indicator can further comprise an antenna extension rod disposed within the first sleeve. The length of the first sleeve can be greater than or equal to 20 cm. The reinforcing member, top clip, and bottom clip can be covered by the strap and disposed between the net and the strap to prevent players directly contacting the top clip and bottom clip. The first sleeve can be coupled to the outside surface of the strap, a second sleeve can be coupled to the outside surface of the strap below the first sleeve and in-line with the first sleeve, and the aligning device can be configured as an illuminating device and disposed within the second sleeve. The top and bottom clips can comprise clamps comprising first and second opposing arms comprising a spring action. The clamps can comprise a height greater than or equal to a width. The straps of the net boundary indicator can further comprise a first end, a second end separated from the first end by a distance greater than or equal to 102 centimeters, and hook and loop attachment elements coupled to the first and second end of the strap, respectively, for securing the strap around a net.

In another aspect, the net boundary indicator can comprise a strap comprising an inside surface and an outside surface opposite the inside surface. A top clip can be coupled to the inside surface of the strap. A bottom clip can be coupled to the inside surface of the strap away from the top clip. A sleeve can be coupled along a length of a surface of the strap, and an aligning device can be coupled to the surface of the strap below the sleeve and in-line with the sleeve.

A method of attaching the net boundary indicator to a net on a sport court can comprise coupling the top clip to a top edge of the net, plumbing the net boundary indicator so a plumbing device indicates the net boundary indicator is plumb, activating the aligning device and moving the top clip until the aligning device aligns with a boundary line of the sport court, and coupling the bottom clip to a position along a bottom edge of the net.

The net boundary indicator can further comprise a plumbing device coupled to the inside surface of the strap. The net boundary indicator can further comprise a reinforcing member comprising a top end and a bottom end, the reinforcing member coupled along a length of the inside surface of the strap. The top clip and bottom clip can be covered by the strap and disposed between the net and the strap to prevent players directly contacting the top clip and bottom clip. The top and bottom clips can comprise clamps comprising first and second opposing arms comprising a spring action. The strap can comprise a width greater than or equal to 2.5 centimeters.

In another embodiment, a net boundary indicator can comprise a strap comprising an inside surface and an outside surface opposite the inside surface, and a reinforcing member comprising a top end and a bottom end, the reinforcing member coupled along a length of the inside surface of the strap. A top clip can be coupled to the inside surface of the strap, a bottom clip can be coupled to the inside surface of the strap away from the top clip, and a first sleeve can be coupled along a length of a surface of the strap.

The net boundary indicator can further comprise a plumbing device coupled to the strap. An aligning device can be coupled to the strap. The first sleeve can be coupled along a length of the outside surface of the strap, a second sleeve can be coupled to the outside surface of the strap below the first sleeve and in-line with the first sleeve, and the aligning device can be formed as an illuminating device and disposed within the second sleeve. The top and bottom clips can comprise clamps comprising first and second opposing arms comprising a spring action.

BRIEF DESCRIPTION OF THE DRAWINGS

The drawings show various non-limiting aspects of one or more embodiments disclosed in the written description.

Accordingly, the present disclosure is not limited to the precise arrangements and instrumentalities shown in the drawings.

DETAILED DESCRIPTION

Figure 1A:
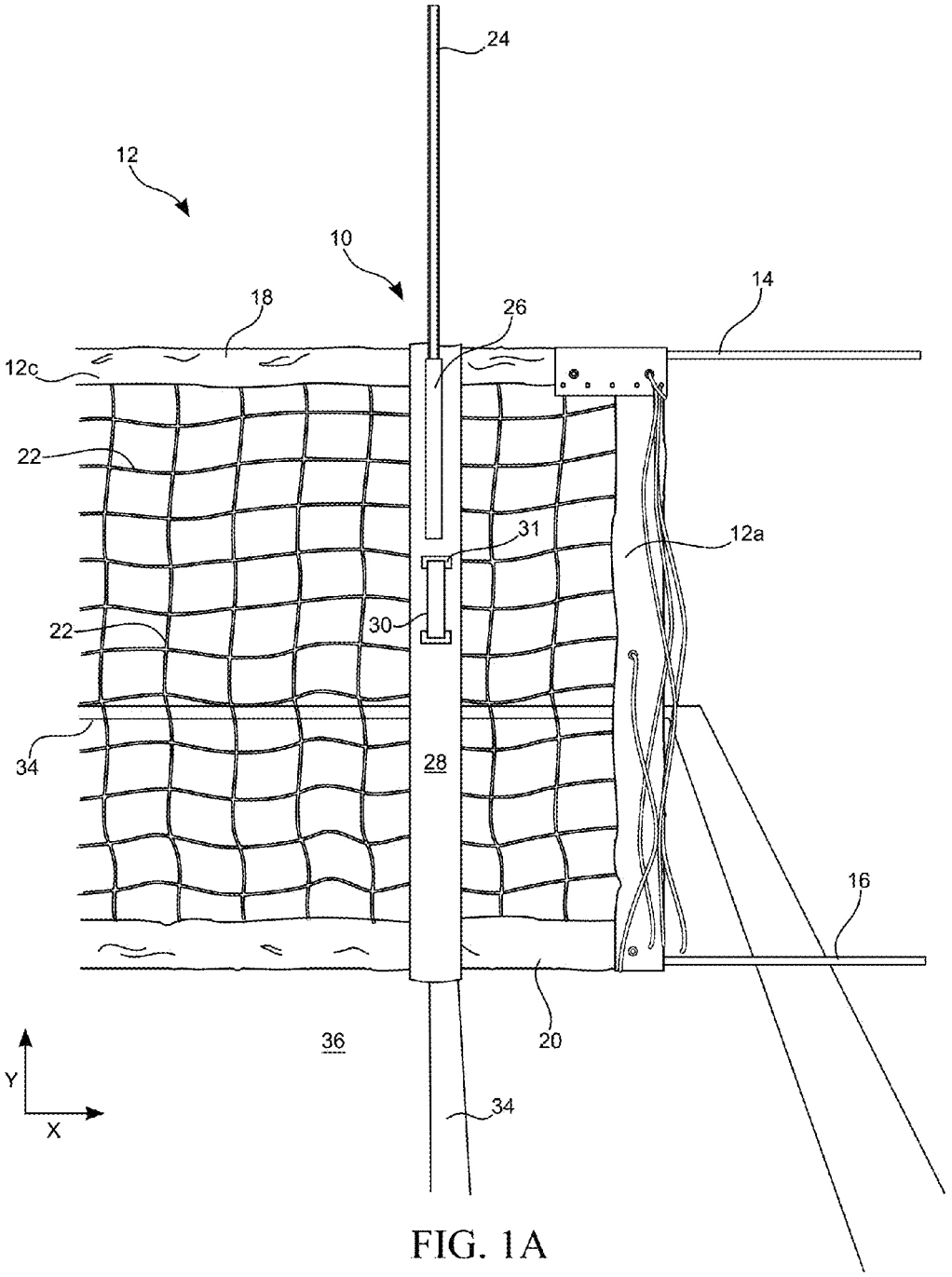
FIGS. 1A-1B show a net boundary indicator coupled on a net.

The present disclosure includes one or more embodiments in the following description with reference to the figures, in which like numerals represent the same or similar elements. This disclosure, its aspects and implementations, are not limited to the specific material types, components, methods, or other examples disclosed herein. It will be appreciated by those skilled in the art that the description is intended to cover alternatives, modifications, and equivalents as may be included within the spirit and scope of the disclosure as defined by the appended claims and their equivalents as supported by the following disclosure and drawings. In the description, numerous specific details are set forth, such as specific configurations, compositions, processes, and implementations, in order to provide a thorough understanding of the disclosure. In other instances, well-known processes and features have not been described in particular detail in order to not unnecessarily obscure the disclosure. Accordingly, although particular implementations are disclosed, such implementations and implementing components may comprise any components, models, types, materials, versions, quantities, and/or the like as is known in the art for such systems and implementing components, consistent with the intended operation. Thus, the various embodiments shown in the FIGs. are illustrative representations and are not necessarily drawn to scale.

The words "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes embodiments of many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

FIG. 1A shows profile view of a net boundary indicator 10 on a side of a net 12. Net 12 can be a game nets for sporting activities, and can include rigid sides such as a volleyball net, a wallyball net, a badminton net, a tennis net, or other net of similar size, shape, or general configuration. Net 12 can be supported in an elevated position by top cable or rope 14 and a bottom rope or cable 16, which can be secured to conventional vertical standards or posts. Net 12 can include an upper sheath 18 that covers or houses top cable 14 and a lower sheath 20 that covers or houses rope 14. Net 12 can comprise of mesh material 22 that can, without limitation, comprise square opening having side lengths of about 4 inches, or any other suitable dimension that complies with relevant regulations.

An antenna extension rod or elongated antenna 24 (antenna) can be of any suitable height, and conventionally comprises a height in a range of about 0.61-1.83 meters (m) (or about 2-6 feet (ft.)). As such, a conventional net comprising a height of about 0.91 m, or about 3 ft., can be totally or at least partially covered or overlapped by antenna 24 such that a portion of the antenna also extends above the net by a distance in a range of about 0.61-1.22 m, or about 2-4 ft. Antenna 24 can be solid and comprise a fixed length. Alternatively, antenna 24 can be segmented, collapsible, or extendable and comprise a plurality of sections. The plurality of sections can be attachable one to another, and can also be telescoping sections that reach a total overall height or length as described above, and are separated, collapsed, or shortened in length to be a fraction of the overall height or length of antenna 24. In either case, antenna 24 can comprise metal, plastic, fiberglass, or other suitable material.

Antenna 24 can comprise a cross-sectional area transverse to its height that is shaped as a circle or any other suitable shape. Antenna 24 can comprise a diameter in a range of about 0.85-2.54 cm (or about ⅓-1 in.), such as about 0.95 cm (⅜ in.) or 1.59 cm (⅝ in.) Antenna 24 can comprise fiberglass, plastic, metal, or any other suitable material.

As shown in FIG. 1A, antenna 24 can be housed in a sleeve 26 that can be coupled to a strap 28 that together form part of net boundary indicator 10. Sleeve 26 and strap 28 can be formed of a same or different material including plastic, vinyl sheeting, metal, fiberglass, and textiles such as nylon, nylon webbing, Cordura® fabrics, cotton, canvas, polyester, or other suitable material.

Sleeve 26 can be configured as an antenna sleeve or as a first sleeve that is configured to receive and be mateably coupled with a bottom or lower portion of antenna 24. Sleeve 26 can comprise a height, width, and thickness, which for convenience, and without limitation, are described with respect to the orientation shown in FIG. 1A. As shown in FIG. 1A, a height, or y-direction extends from a court floor up along a bottom of a net to a top of the net in a plane of FIG. 1A. A width or x-direction is perpendicular or transverse to the y-direction and is also in the plane of FIG. 1A, and further extends in a direction between first end or side 12*a* of net 12 and second end or side 12*b* of the net. A thickness or z-direction is perpendicular or transverse to both the x-direction and y-direction and is in a plane that is perpendicular or transverse to the plane of FIG. 1A. As such, sleeve 26 can comprise a height or length in a range of approximately 7-92 cm (3-36 inches) or approximately 15-40 cm (6-16 inches), and in some embodiments can comprise a height greater than or equal to about 20 cm or (8 in.), 30 cm (12 in.), or 40 cm (16 in.).

Like the variety of possible lengths for sleeve 26, a variety of widths and thicknesses are possible for sleeve 26. Sleeve 26 can comprise a width or an inner diameter that comprises a width (x-direction) and a depth (z-direction), that are substantially equal to or greater than a diameter, width, or depth, of antenna 24. As such, the width or inner diameter of sleeve 26 can be in a range of about 0.85-2.54 cm (or about ⅓-1 in.), such as greater than or equal to about 0.95 cm (⅜ in.) or 1.59 cm, or about ⅝ in. The material forming sleeve 26, like strap 28, can comprise a thickness in a range of about 1.27-2.54 millimeters (mm) (0.05 in.-0.10 in.).

Strap 28 can comprise a height or a length that is greater than or equal to a height of the net to which it is coupled or configured to be releasably coupled. As a non-limiting example for standard volleyball nets comprising a height of 91.44 cm (36 in.), a height or length of strap 28 can be greater than or equal to a height of 91.44 cm. In some embodiments, additional length of strap 28 will be included to allow for the strap to not only extend along a full height of net 12, but to additionally fold around top cable 14 and bottom rope 16 to overlap on opposing sides of the net such as on frontside 12*c* and backside 12*d* of net 12. Overlap of strap 28 on opposing sides 12*c* and 12*d* of net 12 can be of any distance, including distances greater than or equal to about 1-92 cm for a standard volleyball net. As such, an entirety or almost an entirety of backside 12*d* of net 12 can be exposed with respect to strap 28 while a portion of frontside 12*c* of net 12 is covered by strap 28.

In a particular embodiment, an entirety or almost an entirety of backside 12*d* of net 12 can be exposed with respect to strap 28 when a reinforcing member is not used along a length of the strap. A portion of backside 12 can be covered by a first end 28*c* of strap 28. A portion of backside 12 can similarly be covered by a second end 28*d* of strap 28 that is opposite or distal first end 28*c*. First end 28*c* of strap 28 and second end 28*d* of strap 28 can each overlap a length of the strap on backside 12*d* of the net 12 by a distance greater than or equal to about 1 cm, 5 cm (2 in.), and 10 cm (4 in.). A resulting total length of strap 28 can therefore be greater than or equal to about a height of net 12, such as about 94 cm (37 in.), 102 cm (40 in.), and 112 cm (44 in.) or more. While 102 cm can be typical for applications in which net 12 is a volleyball net, other nets of different dimensions used in other sports can of course comprise different heights. Additionally, while first end 28*c* and second end 28*d* can be associated with top and bottom portions of net boundary indictor 10, the first and second ends are not so limited, and the terms first and second can, in particular contexts, be interchangeably used to refer to either a top or bottom ends.

In other embodiments, when a reinforcing member is used along at least a portion of the length of strap 28, the reinforcing member can be covered or shielded by the strap to protect players from contacting the strap and being injured When the reinforcing member is a height of the net, a length of strap 28 can be greater than or equal to about two times a height of the net. For example, when a net has a height of 91.44 cm (36 in.) strap 28 can comprise a length greater than or equal to about 182 cm (72 in.). In some embodiments, inner surfaces 28*b* of both first end 28*c* and second end 28*d* can be releasably coupled to inner surface of 28*b* on front side of net 12*c* from backside of net 12*d*. Additionally, or in place of the coupling described above, in other embodiments, inner surface 28*b* of first end 28*c* can be releasably coupled to outer surface 28*a* of second end 28*d*. Inner surface 28*b* of first end 28*c* can be releasably coupled to outer surface 28*a* of second end 28*d* on backside of net 12*d*. As such, inner surface 28*b* of first end 28C can overlap outer surface 28*a* of second end 28*d* by a distance greater than or equal to about to about 1 cm, 5 cm (2 in.), and 10 cm (4 in.). A resulting total length of strap 28 can therefore be equal to or greater than about 184 cm (72.5 in.), 192 cm (75 in.), and 202 cm (80 in.) or more.

In any event, the coupling of strap 28 around net 12 can be accomplished, without limitation, by coupling the strap to itself using temporary mechanical connections including hook and loop fasteners, snaps, buttons, latches, clips, or any other suitable attachment device. The coupling of strap 28 around net 12 is shown and discussed in greater detail below with respect to FIGS. 1B and 2B.

Like the variety of possible lengths for strap 28, a variety of widths and thicknesses are possible for strap 28. Strap 28 can comprise a width greater than or equal to 1.3 cm (0.5 in.), 2.5 cm (1 in.), or 5 cm (2 in.). Strap 28 can also comprise a thickness in a range of 12.7-25.4 millimeters (mm) (0.05 in.-0.10 in.).

Sleeve or aligning device sleeve 30 can be configured as a second sleeve that is configured to receive, and to be mateably coupled with, aligning device 32. Aligning device 32 can include any device that provides an indication that the net boundary indicator aligns with, is plumb, or is vertically aligned with, boundary line 34 of sports court 36 to which net 12 is associated. Aligning device 32 can comprise a telescoping or extension rod that can extend downward from the net boundary indicator to contact or be in close proximity of boundary line 34 of sports court 36. Close proximity of an aligning device 32 rod to boundary line 34 of sports court 36 can comprise a distance in a range of about 0-30 cm (or 0-12 in.) so that aligning device 32 rod contacts boundary line 34, or is readily discernable to the human eye to be aligned to boundary line 34. Aligning device 32 can further comprise an illuminating device that transmits an optical signal from the illuminating device and net boundary indicator 10 to boundary line 34 of sports court 36 so that the alignment of the net boundary indicator with respect to boundary line 34 of sports court 36 is readily discernable to the human eye or to a person setting up net boundary indicator 10 on net 12. As such, an illuminating device can comprise a laser, a light emitting diode (LED), a flashlight, or any of the forgoing comprising a filter, screen, or lens that shapes, channels, or directs light to provide an optical signal or pattern that when shown on boundary line 34 indicates to the human eye or to a person setting up net boundary indicator 10 that the net boundary indicator is aligned with boundary line 34 of sports court 36.

Sleeve 30 can comprise a height, width, and thickness, which for convenience, and without limitation, are described with respect to the orientation shown in FIG. 1A and described above. A height, width, and thickness of sleeve 30 can comprise an interior space greater than or equal to aligning device 32, and can be formed or arranged to receive and be mateably coupled to aligning device 32. In some embodiments, sleeve 30 can comprise a height or length in a range of approximately 0.64-25.4 cm (0.25-10 inches). Sleeve 30 can comprise a width or an inner diameter that comprises a width (x-direction) and a depth (z-direction), that are substantially equal to or greater than a diameter, width, or depth, of aligning device 32. As such, the width or inner diameter of sleeve 30 can be greater than or equal to about 0.64 cm (0.25 in.). The material forming sleeve 26, like strap 28, can comprise a thickness in a range of about 1.27-2.54 millimeters (mm) (0.05 in.-0.10 in.).

Sleeve 30 can be directly attached sleeve 28, or as shown in FIG. 1A, can be coupled to the sleeve using one or more intermediate layers or materials such as mounting pads 31. Mounting pads 31 can comprise any material used for strap 28, and can additionally comprise other materials. Mounting pads can comprise a foam material or other material to provide cushion or shock absorption to reduce or minimize vibrations and movement of aligning device 32. Mounting pads can be used to adjust alignment between aligning device 33 and antenna 24 so that the aligning device and antenna are coplanar and co-axially aligned, such as in the y-direction. Mounting pads 31 can optionally include adjustment features for adjusting the alignment between sleeve 26 and sleeve 30, or between aligning device 33 and antenna 24. Mounting pads 31 can be disposed between sleeve 30 and strap 28. Mounting pads 31 can also be disposed between sleeve 26 and strap 28.

While sleeve 26 and sleeve 30 are shown in FIG. 1A comprising a solid cylindrical or tubular sleeve, the sleeves can further comprise a number of openings, vents, or a series of aligned hoops that form a broken or intermittent surface. Additionally, while sleeves 26 and 30 are shown coupled to, and exposed with respect to, outer surface 28*a* of strap 28, in some embodiments one or more of the sleeves can be covered by, or offset from, the outer surface. For example, sleeve 26 could be coupled to inner surface 28*b* of strap 28 and on opening could be formed between outer surface 28*a* and inner surface 28*b* to allow for antenna 24 to extend from sleeve 26 coupled to inner surface 28*b* through or past outer surface 28*a*. Similarly, sleeve 30 could be coupled to inner surface 28*b* of strap 28 and on opening could be formed between outer surface 28*a* and inner surface 28*b* to allow for aligning device 30 or a signal from aligning device 30 to extend from sleeve 30 coupled to inner surface 28*b* through or past outer surface 28*a* to boundary line 34. Advantageously, placement of sleeve 30 and aligning device 32 on outer surface 28*a* of sleeve 28 provides easy access for a user to activate the aligning device and determine alignment of net boundary indicator 10 relative to boundary line 34. While placement of sleeve 30 and aligning device 32 on strap 28 can also be below (or lower off the court) than bottom clip 38*b* greater safety and protection to players can be provided by forming a padded or protecting sleeve 30 above (or higher off the court) than bottom clip 38*b*, such that sleeve 30 is disposed on strap 28 between top clip 38*a* and bottom clip 38*b*.

Whether coupled to outer surface 28*a* or inner surface 28*b*, sleeve 26 and sleeve 30 can be disposed in-line with one another with sleeve 26 being disposed over, above, or higher than sleeve 30, and sleeve 30 being disposed under, below, or lower than sleeve 26. In some embodiments antenna sleeve 26, antenna 24 when disposed within antenna sleeve 26, and aligning device 32 will be co-axially aligned so that, for example, when aligning device 32 is an illuminating device, a laser or beam of light extending from the aligning device will be coextensive with an alignment of a central axis of antenna 24 so that a person installing or attaching net boundary indictor 10 to net 12 can identify when the net boundary indicator and antenna are properly aligned with boundary line 34.

Figure 1B:
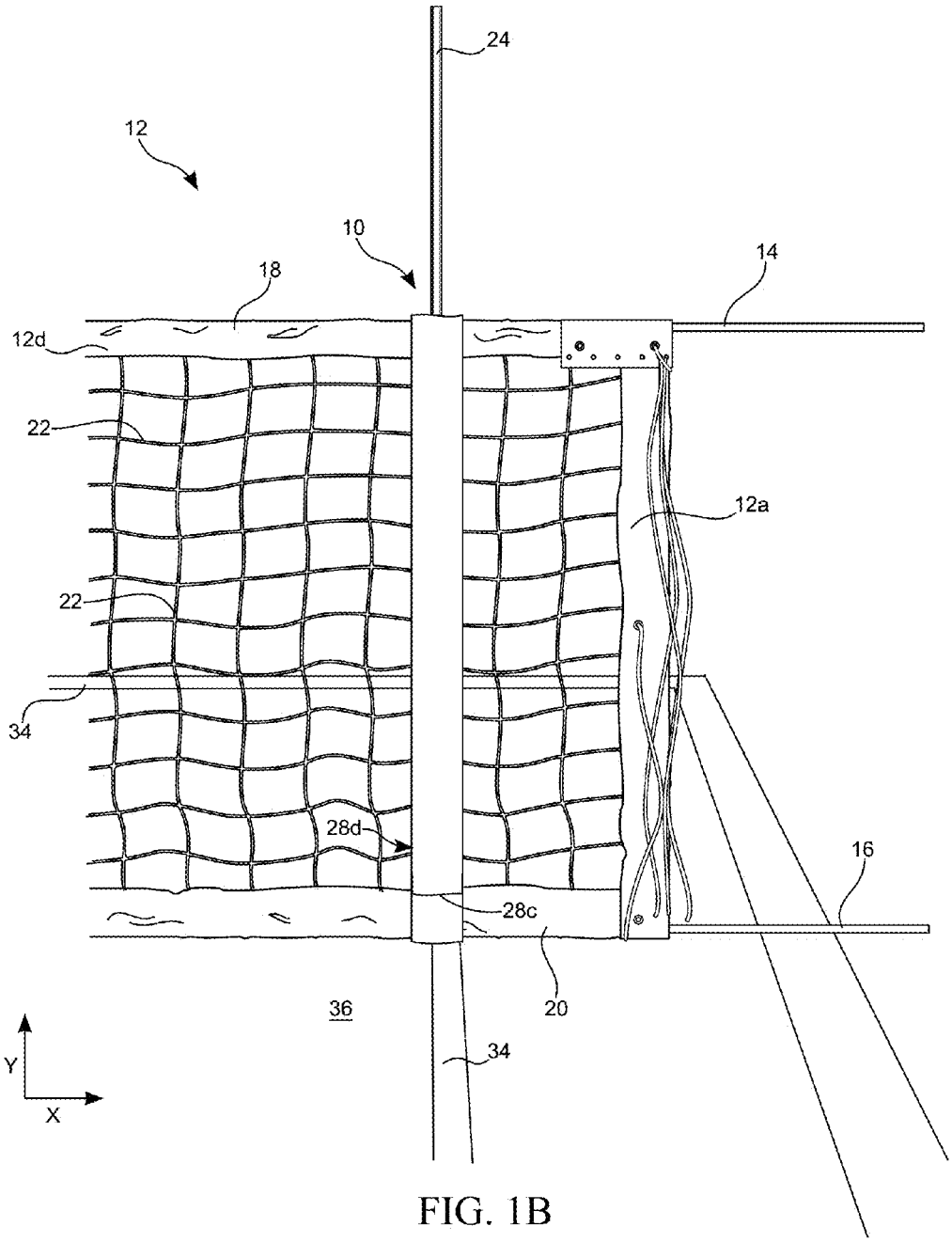

As shown in FIGS. 1A and 1B, any clip or attachment device 38 coupling net boundary indicator 10 to net 12, such as clips, hooks, hook and loop fasteners, snaps, buttons, latches, or any other suitable attachment device, can be covered or protected by strap 28. Clips 38 can be formed of metal, wood and particularly light weight woods, fiberglass, or plastics, such as such as polypropylene, polyethylene (PE), vinyl, polyvinylchloride (PVC), or other suitable material. By having strap 28 cover any or all clips 38 or other attachment devices, player safety can be increased because players are not exposed to hard, angular, or sharp objects. Instead, clips 30 are covered by strap 28 and clips 30 are disposed between net 12 and strap 28 to prevent players directly contacting, and being injured by, the clips.

Accordingly, a method of attaching net boundary indicator 10 to a net 12 on a sport court 36 can comprise coupling a top clip 38*a* to top cable 14, or a top edge, of the net. The method can further comprise plumbing net boundary indicator 10 so plumbing device 40 such as a level or bubble level indicates the net boundary indicator is plumb. The method can further comprise activating aligning device 30 and moving top clip 38*a* until aligning device 30 aligns with boundary line 34 of the sport court 36. The method can further include coupling bottom clip 38*b* to a position along bottom rope 16, or a bottom edge, of net 12.

FIG. 1B shows a view of net boundary indicator 10 on net 12 opposite the view shown in FIG. 1A so that backside 12*d* of net 12 is shown as well as an opposite or reverse side of the net boundary indicator. FIG. 1B further shows strap 28 can comprise first end 28*c* opposite second end 28*d*. First end 28*c* of strap 28 can comprise or be coupled to a first attachment element 42*a* that can be coupled to inner surface 28*b* of the first end of the strap. Second end 28*d* of strap 28 can comprise or be coupled to a second attachment element 42*b* that can be coupled to outer surface 28*a* of the second end. Second attachment element 42*b* can be releasably coupled to first attachment element 42*a* so that both first attachment element 42*a* and second attachment element 42*b* can be releasably coupled to each other to hold net boundary indicator 10 to net 12 while being covered by strap 28. First attachment element 42*a* and second attachment element 42*b* can comprise hook and loop fasteners, snaps, buttons, latches, clips, or any other suitable attachment devices for releasably coupling first end 28*c* and second end 28*d* of strap 28 around net 12, including for example, upper sheath 18 and lower sheath 20.

Figure 2A:
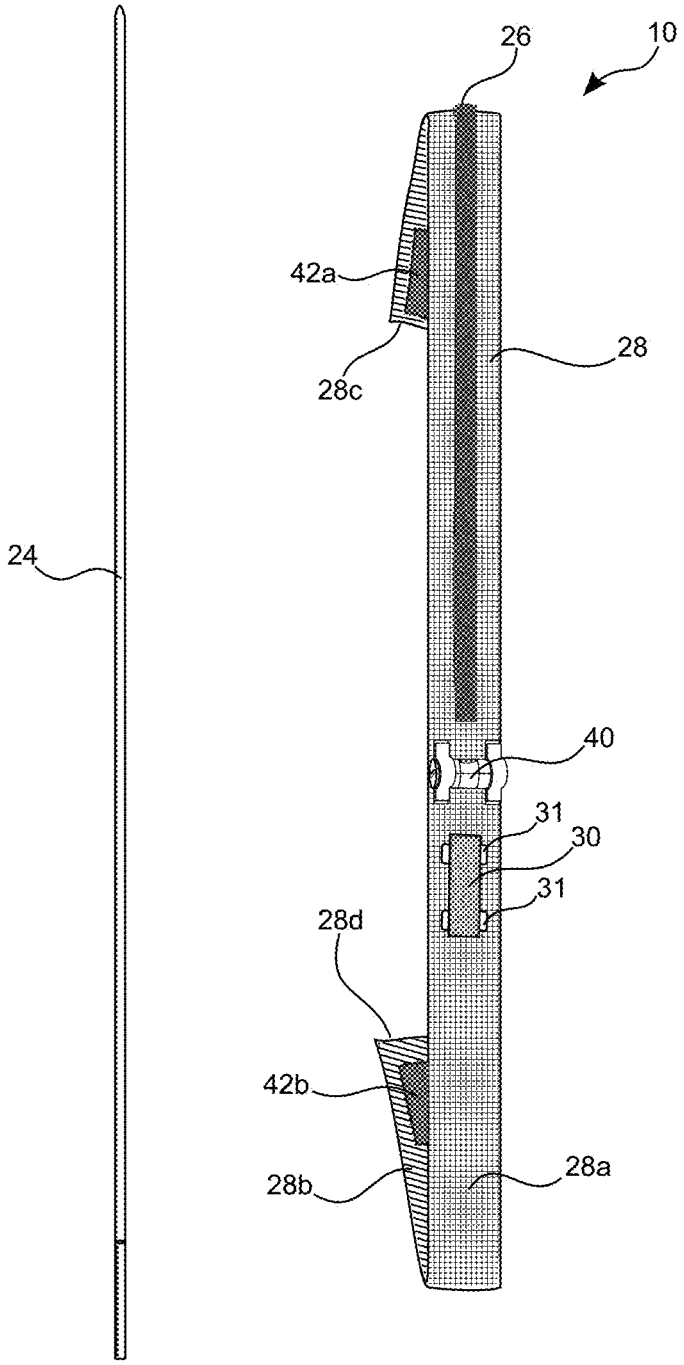
FIGS. 2A-2B show various views of a net boundary indicator.
Figure 2B:
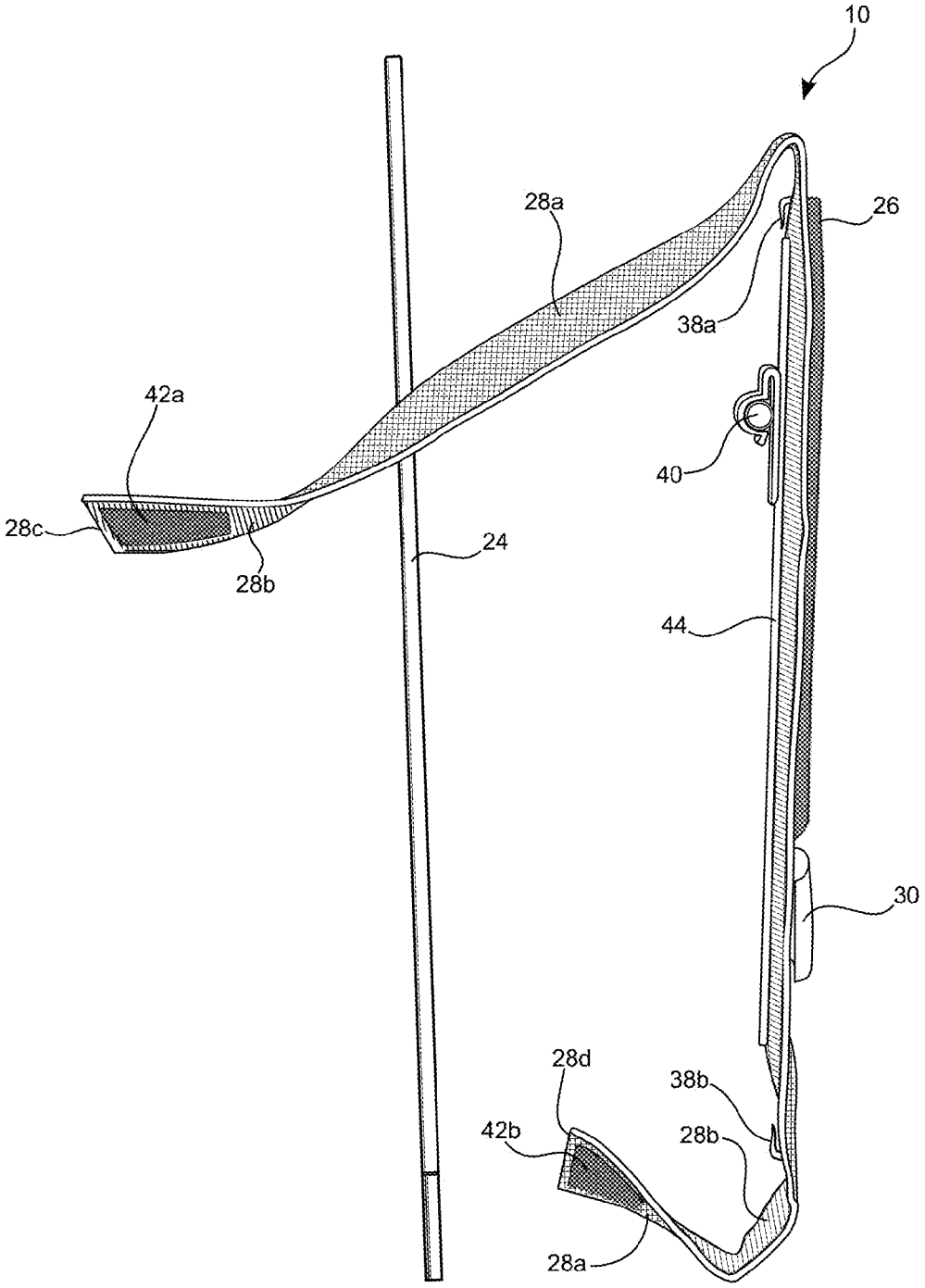

FIGS. 2A-2B show various views of a net boundary indicator 10. FIG. 2A shows a profile view of a net boundary indicator 10, similar to the view shown in FIG. 1A without including net 12. FIG. 2A shows outer surface 28*a* of net boundary indicator 10 with sleeve 26 coupled or attached to strap 28 above sleeve 30 and plumbing device, level, or bubble level 40, which can also coupled or attached to outer surface 28*a* of strap 28. While plumbing device 40 is disposed between sleeve 26 and sleeve 30 in the y-direction along a length or height of sleeve 28, plumbing device 40 can be coupled at any position along net boundary indicator 10. When plumbing device 40 is a bubble level, the bubble level can show plumbness in one dimension, such as in the x-direction across a width of a court and net 12. Additionally, the bubble level can show plumbness in two dimensions, or in a plane, such as in the x-direction across a width of a court and net 12 and in a z-direction perpendicular to the x-direction.

FIG. 2A additionally shows antenna 24 adjacent strap 28 and sleeve 26, into which the antenna can be disposed. First attachment element 42*a* is shown coupled to, or near, first end 28*c* of strap 28. Similarly, second attachment element 42*b* is shown coupled to, or near, second end 28*d* of strap 28 opposite first end 28*c*. Attachment elements 42, comprising first and second attachment elements 42*a* and 42, respectively, can comprise hook and loop fasteners, snaps, buttons, latches, clips, or any other suitable attachment device for releasably coupling first end 28*c* and second end 28*d* of strap 28 around net 12, including for example, upper sheath 18 and lower sheath 20.

FIG. 2B shows a side view of net boundary indicator 10 that is perpendicular to the view shown in FIG. 2A. FIG. 2B includes additional detail of clips 38, of plumbing device 40, of attachment elements 42, and of reinforcing member 44. Clips 38 are included as part of net boundary indicator 10 as top clip 38*a* and bottom clip 38*b*, both of which can be attached to inner surface 28*b* of strap 28. Various aspects of clips 38 are discussed in greater detail below with respect to FIG. 3A-3C. Plumbing device 40 is shown coupled or attached to strap 28, or to reinforcing member 44, and oriented towards and coupled to inner surface 28*b* of strap 28. However, as part of other configurations, and as shown above in FIG. 2A, plumbing device 40 can also be coupled or attached to outer surface 28*a* of strap 28. Similarly, plumbing device 40 can also be incorporated with or disposed within sleeve 26, sleeve 30, or within an additional sleeve or pocket to increase player safety should a player contact the plumbing device during play. After coupling a first clip 38 to a position along net 12 over boundary line 34, such as top clip 38*a* to top cable 16 or bottom clip 38*b* to bottom rope 16, the person coupling the net boundary indicator to the net can observe if the net boundary indicator is level by viewing plumbing device 40, and adjusting an alignment or relative position of clips 38 along the net until the plumbing device indicates the net boundary indicator is plumb or vertically aligned with respect to boundary line 34.

As indicated above, first end 28*c* can have first attachment element 42*a* coupled to inner surface 28*b*, while second end 28*d* can have second attachment element 42*b* coupled to outer surface 28*a* as shown in FIG. 2B. Alternatively, first end 28*c* can have first attachment element 42*a* coupled to outer surface 28*a* while second end 28*d* can have second attachment element 42*b* coupled to inner surface 28*b*. In yet another embodiment, both first end 28*c* and second end 28*d* can have first and second attachment elements 42*a* and 42*b*, respectively, coupled to inner surface 28*b* so that instead of first and second attachment elements 42*a* and 42*b* being coupled to each other, an inner surface 28*b* of both first end 28*c* and second end 28*d* of strap 28 can be coupled to an inner surface of 28*b* of a central portion of strap 28, as shown in FIG. 2A. In any event, by providing tension along strap 28, net boundary indicator 10 is firmly coupled to net 12 so that the net boundary indicator can withstand impacts and vibrations caused by, or transferred through, players and the net, while maintaining proper boundary alignment with respect to boundary line 34 during a game.

FIG. 2B further shows a reinforcing member 44 coupled to strap 28 to provide additional strength and rigidity to the strap. Reinforcing member 44 can comprise metal, wood and particularly light weight woods, fiberglass, or plastic, such as polypropylene, polyethylene (PE), vinyl, polyvinylchloride (PVC), or other suitable material. Reinforcing member 44 can comprise a top end and a bottom end, the reinforcing member being coupled along a length of strap 28. Reinforcing member 44 can be coupled to outer surface 28*a* or inner surface 28*b* of strap 28, and when coupled to the inner surface can be covered or shielded by the strap to increase player safety. Reinforcing member 44 can be mechanically or chemically couple to strap 28 using glues, adhesives, hook and loop fasteners, snaps, buttons, latches, clips, or any other suitable attachment devices or materials. In some embodiments, sewn straps, bands, pockets, sleeves, or other retaining device can be formed as part of strap 28 to facilitated coupling of reinforcing member 44 to the strap.

By providing reinforcing member 44 together with strap 28, net boundary indicator 10 can better maintain alignment of antenna 24 than with only a strap. Reinforcing member 44 can extend along net boundary indicator 10 an entire height of net 12, and thus overlap or contact clips 38. Reinforcing member 44 can also extend under and overlap with plumbing device 40, such that the plumbing device can be coupled or attached to the reinforcing member. In other embodiments, reinforcing member 44 can extend along a portion of net boundary indicator 10 less than an entire height of net 12 such that the reinforcing member does not overlap or contact clips 38, plumbing device 40, or both. As shown subsequently in FIG. 3B, reinforcing member 44 can be offset or form a gap with respect to clip 38.

Thus, in some embodiments, top clip 38*a*, bottom clip 38*b*, plumbing device 40, and reinforcing member 44 can all be covered by strap 28 and disposed between net 12 and the strap to increase player safety and prevent players from directly contacting the top clip, bottom clip, plumbing device, and reinforcing member.

Figure 3A:
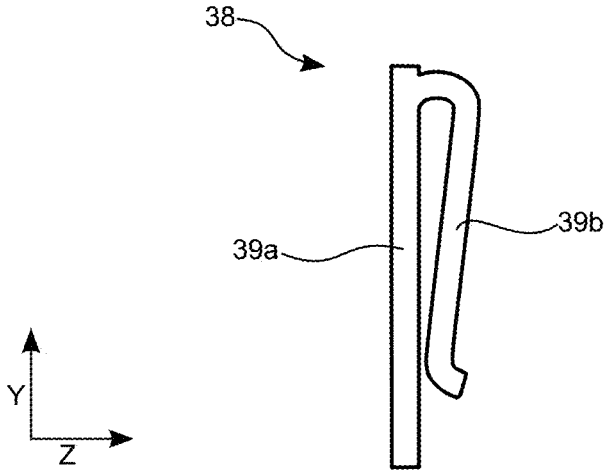
FIGS. 3A-3C show various views of net boundary indicator clips.
Figure 3B:
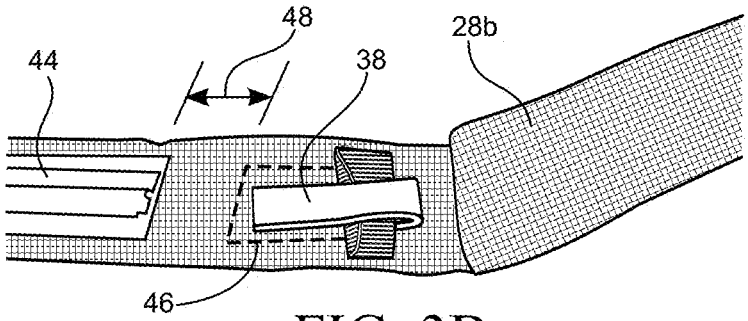
Figure 3C:
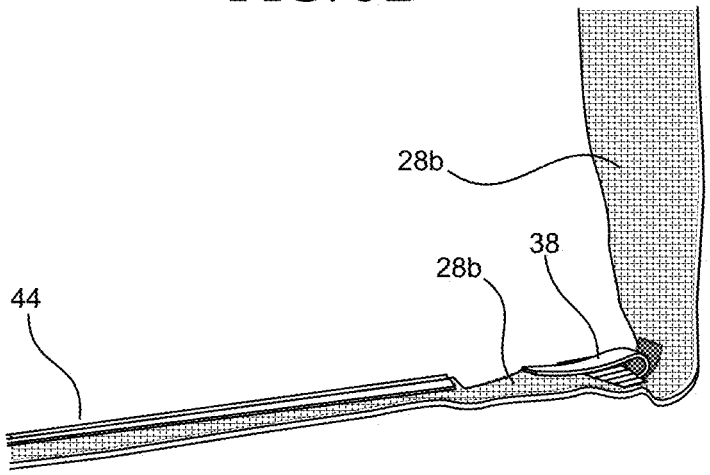

FIGS. 3A-3C show various views of clip 38 both together and separate from net boundary indicator 10. FIG. 3A shows a cross sectional view of a clip 38 that is an example of a possible attachment device described above with respect to FIG. 1A. Clip 38 can comprise a clamping clip that comprises a first clamp arm 39*a* and second clamp arm 39*b* that opposes, and is disposed opposite from, the first clamp arm. Clip 38 can further comprises an arc or u-shaped connecting section that can be part of, or separate from, the first and second clamp arms 39 and 39*b*. The connecting section can form a live hinge portion or spring at the junction of the first and second clamp arms 39 and 39*b*. Thus, the connecting section can allow first and second clamp arms 39 and 39*b* to clamp together in the z-direction, perpendicular to the height or length of the strap 28. Second clamp arm 39*b* can be coupled to first clamp arm 39*a* so that when at rest, the first and second clamp arms contact, or a small opening or gap exists between the first and second clamp arms. Second clamp arm 39*b* can be deformably and temporarily moveable from first clamp arm 39*a* such that the second clamp arm can alternately spring away from, and towards, the first clamp arm when being coupled to net 12, such as top cable 14 and bottom rope 16. As such, clip 38 can be removably attached to net 12 and allow for adjustable alignment of net boundary indicator 10 with respect to boundary line 34 while coupled to net 12.

Additionally, by providing net boundary indicator 10 with both a top clip 38*a* and a bottom clip 38*b* together with attachment elements 42 on strap 28, unwanted movement of antenna 24 is reduced or minimized, while allowing the net boundary indicator to remain attached to the net during net movement and vibrations incident to playing of the sport. Unwanted relative movement between net boundary indicator 10 and net 12 can be further reduced or minimized by forming clamps 38 with a height (in the y-direction) greater than or equal to a width (in the x-direction).

FIG. 3B shows a perspective view of clip 38 coupled to strap 28 adjacent reinforcing member 44 as part of net boundary indicator 10. More specifically, FIG. 3B shows clip 38 removably coupled to strap 28 by being disposed within a pocket 46 formed on inner surface 28*b*. When clip 38 has first clamp arm 39*a* disposed within pocket 46 and second clamp arm 39*b* disposed outside pocket 46, reinforcing member 44 can be offset or separated from the clip and pocket by a gap or offset 48 in the y-direction along a length of strap 28 as shown. Alternatively, in other embodiments clip 38 can be coupled to, or over, reinforcing member 44 so that the clip and reinforcing member overlap one another and are stacked with respect to one another in the z-direction. As indicated previously, and as shown in FIG. 3B, clips 38 can comprise a height greater than or equal to a width of the clip. FIG. 3C shows another perspective view of clip 38 and reinforcing member 44 coupled to inner surface 28*b* of strap 28 as part of net boundary indicator 10, which is rotated approximately 90 degrees from the view shown in FIG. 3B.

Figure 4A:
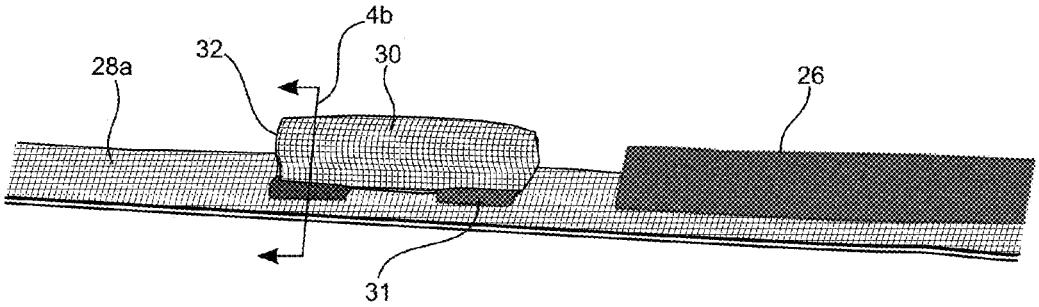
FIGS. 4A-4B show detail of an aligning device coupled to the net boundary indicator.
Figure 4B:
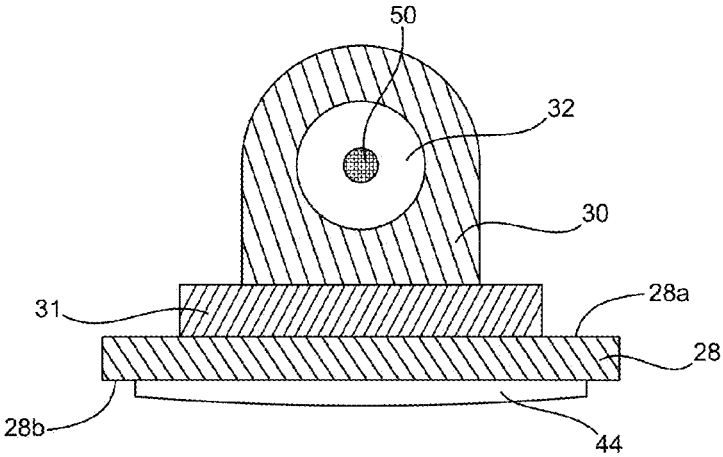

FIGS. 4A-4B show a perspective view of an aligning device 32 disposed within sleeve 30, in which the sleeve is coupled to outer surface 28*a* of strap 28 as part of net boundary indicator 10. FIG. 4A shows a close-up perspective view of aligning device 32 disposed within sleeve 30 and coupled to outer surface 28*a* of strap 28 adjacent to a portion of sleeve 26 that is also coupled to outer surface 28*a* of strap 28.

FIG. 4B shows cross-sectional profile view of net boundary indicator 10 taken along section line 4B shown in FIG. 4A. As shown in FIG. 4B, alignment device 32, such as a laser or illuminating device, can comprise optical projection area 50, from which an optical signal can emanate to show relative alignment between net boundary indicator 10 and boundary line 34. Alignment device can be disposed within sleeve 30, and sleeve 30 can be coupled to one or more mounting pads 31 and strap 28, and reinforcing member 44.

In the foregoing specification, various embodiments of the disclosure have been described. It will, however, be evident that various modifications and changes may be made thereto without departing from the broader spirit and scope of the inventions as set forth in the appended claims. The specification and drawings are, accordingly, to be regarded in an illustrative sense rather than a restrictive sense.

What is claimed is:

1. A net boundary indicator in combination with a sports net, comprising:

a strap comprising an inside surface and an outside surface opposite the inside surface, the strap further comprising a first height defined by a distance between a top end of the strap and a bottom end of the strap opposite the top end of the strap;

a first portion of hook and loop fasteners disposed at the top end the strap;

a second portion of hook and loop fasteners disposed at the bottom end the strap;

a reinforcing member comprising a second height less than the first height, the second height being defined by a distance between a top end of the reinforcing member and a bottom end of the reinforcing member, the reinforcing member attached along a portion of the inside surface of the strap with the top end of the reinforcing member offset from the top end of the strap and the bottom end of the reinforcing member offset from the bottom end of the strap;

a top clip coupled to the inside surface of the strap adjacent the top end of the reinforcing member for attachment to a top cable of the sports net, the top clip working in combination with the first portion of hook and loop fasteners to secure the top end of the reinforcing member to the top cable of the sports net by folding the top end of the strap around the top cable;

a bottom clip coupled to the inside surface of the strap adjacent the bottom end of the reinforcing member for attachment to a bottom cable of the sports net, the bottom clip working in combination with the second portion of the hook and loop fasteners to secure the bottom end of the reinforcing member to the bottom cable of the sports net by folding the bottom end of the strap around the bottom cable;

a first sleeve attached along the height of the outer surface of the strap and sized to receive an antenna;

an aligning device coupled to the surface of the strap below the first sleeve and in-line with the first sleeve; and a bubble level coupled to the strap.

2. The net boundary indicator of claim 1, wherein the top clip and the bottom clip comprise clamps comprising first and second opposing arms comprising a spring action.

3. The net boundary indicator of claim 2, wherein:

the clamps comprise a height greater than or equal to a width; and the first height of the strap is greater than or equal to 102 centimeters.

4. The net boundary indicator of claim 1, further comprising:

the first sleeve coupled to the outside surface of the strap;

a second sleeve coupled to the outside surface of the strap below the first sleeve and in-line with the first sleeve; and the aligning device configured as an illuminating device and disposed within the second sleeve.

5. The net boundary indicator of claim 1, wherein the reinforcing member, top clip, and bottom clip are covered by the strap and disposed between the sports net and the strap to prevent players directly contacting the top clip and bottom clip.

6. The net boundary indicator of claim 1, further comprising an antenna extension rod disposed within the first sleeve.

7. The net boundary indicator of claim 1, wherein the length of the first sleeve is greater than or equal to 20 cm.

8. A method of attaching the net boundary indicator of claim 1 to the sports net, comprising:

attaching the top clip to the top cable of the sports net and attaching the bottom clip to the bottom cable of the sports net;

aligning the net boundary indicator to a boundary line with the aligning device after attaching the top clip to the sports net;

plumbing the net boundary indicator to the line on the court and the sports net after attaching the top clip and the bottom clip to the sports net;

folding the top end of the strap around the top cable of the sports net to secure the top end of the strap with the first portion of hook and loop fasteners after aligning and plumbing the net boundary indicator;

folding the bottom end of the strap around the bottom cable of the sports net to secure the bottom end of the strap with the second portion of hook and loop fasteners after aligning and plumbing the net boundary indicator; and using the first portion and the second portion of the hook and loop fasteners to the first and second end of the strap, respectively, for securing the strap around the sports net.

9. A net boundary indicator in combination with a sports net, comprising:

a strap comprising an inside surface and an outside surface opposite the inside surface;

a first portion of hook and loop fasteners disposed at the top end the strap;

a second portion of hook and loop fasteners disposed at the bottom end the strap;

a top clip coupled to the inside surface of the strap for attachment to the sports net, the top clip working in combination with the first portion of hook and loop fasteners to secure the top end of the strap by folding the top end of the strap around the top of the sports net;

a bottom clip coupled to the inside surface of the strap away from the top clip for attachment to the sports net, the bottom clip working in combination with the second portion of hook and loop fasteners to secure the bottom end of the strap by folding the bottom end of the strap around the bottom of the sports net;

a sleeve coupled along a length of a surface of the strap; and an aligning device coupled to the surface of the strap below the sleeve and in-line with the sleeve.

10. The net boundary indicator of claim 9, further comprising a plumbing device coupled to the inside surface of the strap.

11. The net boundary indicator of claim 9, further comprising a reinforcing member comprising a top end and a bottom end, the reinforcing member coupled along a length of the inside surface of the strap.

12. The net boundary indicator of claim 9, wherein the top clip and bottom clip are covered by the strap and disposed between the net and the strap to prevent players directly contacting the top clip and bottom clip.

13. The net boundary indicator of claim 9, wherein the top and bottom clips comprise clamps comprising first and second opposing arms comprising a spring action.

14. The net boundary indicator of claim 9, wherein the strap comprises a width greater than or equal to 2.5 centimeters.

15. A method of attaching the net boundary indicator of claim 9 to the sports net, comprising:

coupling the top clip to a top edge of the net;

plumbing the net boundary indicator so a plumbing device indicates the net boundary indicator is plumb;

activating the aligning device and moving the top clip until the aligning device aligns with a boundary line of the sport court;

coupling the bottom clip to a position along a bottom edge of the net; and after plumbing and aligning the top clip and the bottom clip, securing hook and loop fastener straps to prevent movement of the top clip and the bottom clip.

16. A net boundary indicator in combination with a sports net, comprising:

a strap comprising an inside surface and an outside surface opposite the inside surface;

a first fastener disposed at the top end the strap;

a second fastener disposed at the bottom end the strap;

a top clip coupled to the inside surface of the strap for attachment to the sports net, the top clip working in combination with the first fastener to secure the top end of the strap by folding the top end of the strap around the top of the sports net;

a bottom clip coupled to the inside surface of the strap away from the top clip for attachment to the sports net, the bottom clip working in combination with the second fastener to secure the bottom end of the strap by folding the bottom end of the strap around the bottom of the sports net;

a sleeve sized to receive an antenna coupled to the strap; and an aligning device coupled to the strap in-line with the sleeve.

17. The net boundary indicator of claim 16, further comprising a plumbing device coupled to the strap.

18. The net boundary indicator of claim 16, further comprising an antenna extension rod disposed within the sleeve.

19. The net boundary indicator of claim 16, wherein the aligning device is configured as an illuminating device.

20. A method of attaching the net boundary indicator of claim 16 to the sports net, comprising:

attaching the top clip to the top of the sports net and attaching the bottom clip to the bottom of the sports net;

aligning the net boundary indicator to a boundary line with the aligning device after attaching the top clip to the sports net;

plumbing the net boundary indicator to the line on the court and the sports net after attaching the top clip and the bottom clip to the sports net;

folding the top end of the strap around the top of the sports net to secure the top end of the strap with the first fastener after aligning and plumbing the net boundary indicator; and folding the bottom end of the strap around the bottom of the sports net to secure the bottom end of the strap with the second fastener after aligning and plumbing the net boundary indicator.

* * * * *